US008139961B2

(12) United States Patent
Mandel et al.

(10) Patent No.: US 8,139,961 B2
(45) Date of Patent: Mar. 20, 2012

(54) DIAGNOSTIC METHOD AND SYSTEM FOR MODULAR PRINTING SYSTEMS

(75) Inventors: Barry Paul Mandel, Fairport, NY (US); Steven Robert Moore, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 976 days.

(21) Appl. No.: 12/106,687

(22) Filed: Apr. 21, 2008

(65) Prior Publication Data

US 2009/0263145 A1 Oct. 22, 2009

(51) Int. Cl.
*G03G 15/00* (2006.01)

(52) U.S. Cl. ..... 399/18

(58) Field of Classification Search ..... 399/9, 18–20, 399/25, 31

See application file for complete search history.

(56) References Cited

U.S. PATENT DOCUMENTS

| | | | | |
|---|---|---|---|---|
| 5,010,551 | A | 4/1991 | Goldsmith et al. | |
| 5,812,902 | A * | 9/1998 | Lee | 399/25 |
| 6,931,355 | B2 | 8/2005 | Farrell et al. | |
| 2003/0110413 | A1 | 6/2003 | Bernklau-Halvor | |
| 2006/0039727 | A1 | 2/2006 | Lofthus et al. | |
| 2006/0039729 | A1 | 2/2006 | Mandel et al. | |
| 2006/0114313 | A1 | 6/2006 | Moore | |
| 2006/0114497 | A1 | 6/2006 | Anderson et al. | |
| 2006/0182454 | A1 * | 8/2006 | Sippel et al. | 399/18 |
| 2006/0221159 | A1 | 10/2006 | Moore et al. | |
| 2007/0036559 | A1 | 2/2007 | Thomas | |
| 2007/0168758 | A1 | 7/2007 | Kolb et al. | |

* cited by examiner

*Primary Examiner* — David Gray
*Assistant Examiner* — Billy J Lactaoen
(74) *Attorney, Agent, or Firm* — Fay Sharpe LLP

(57) ABSTRACT

Disclosed are methods and systems to diagnose modular printing systems having two or more interchangeable modules. In addition, methods and systems are provided to generate instructions for configuring the interchangeable modules within the printing system to produce optimal results.

18 Claims, 5 Drawing Sheets

DIAGNOSTIC METHOD AND SYSTEM FOR MODULAR PRINTING SYSTEMS

BACKGROUND

This disclosure relates to modular printing systems. Specifically, this disclosure relates to the diagnosing of printing system faults which may be attributed to a failed printing system component.

Integrated printing systems include the integration of many devices to provide a complete printing system. The integrated devices may include image marking engines (IMEs), media sheet feeder devices, media sheet transport devices, fusing devices, interface devices and output devices such as sheet stackers and media finishing devices. In addition to including the integration of multiple devices that provide distinct functions for the printing system, an integrated printed system may include two or more similar or identical devices, for example two sheet feeder devices, two IMEs and two media sheet stacker devices. The addition of multiple devices with similar or identical functions can provide increased productivity for the printing system.

One of the big contributions to the run-cost associated with an integrated printing system is the costs associated with parts replacement. Sometimes the cost of parts replacement is unnecessarily amplified due to the replacement of parts to determine if a particular problem is corrected. For example, the user of an integrated printing system may replace parts associated with the printing system until the problem is corrected, where one failed part is corrected by the replacement of one or more normally operating parts in addition to the failed part. This disclosure provides a method and system to diagnose modular printing system faults.

INCORPORATION BY REFERENCE

U.S. Patent Publication No. 2003/0110413 by Bernklau-Halvor, published Jun. 12, 2003 and entitled "METHOD FOR ANALYZING PRINTER FAULTS" and U.S. Pat. No. 6,931,355 by Farrell et a., issued Aug. 16, 2005 and entitled "METHOD AND APPARATUS FOR PROVIDING DATA LOGGING IN A MODULAR DEVICE" are totally incorporated herein by reference.

BRIEF DESCRIPTION

According to one aspect of the disclosure, a method for diagnosing a modular printing system having two or more interchangeable modules is described. The method comprises a) determining a fault associated with the printing system has occurred; b) a controller identifying a first potentially failed module causing the fault; c) the controller identifying a first normally operating module interchangeable with the potentially failed module; d) the controller generating instructions to swap the first potentially failed module with the first normally operating module; e) executing the instructions; and f) determining if the fault in the first area of the printing system has been corrected subsequent to executing the instructions to swap the first potentially failed module with the first normally operating module.

According to another aspect of the disclosure, a modular printing system controller is disclosed which comprises configuring the controller to execute the method of diagnosing described above.

According to another aspect of the disclosure, a xerographic printing system is disclosed. The printing system comprises two or more image marking engines (IMEs); one or more media sheet feeder devices operatively connected to the two or more IMEs; one or more media sheet output devices operatively connected to the two or more IMEs; and a controller operatively connected to the xerographic printing system, the controller configured to execute the method of diagnosing a modular printing system described above.

DETAILED DESCRIPTION

Figure 1:
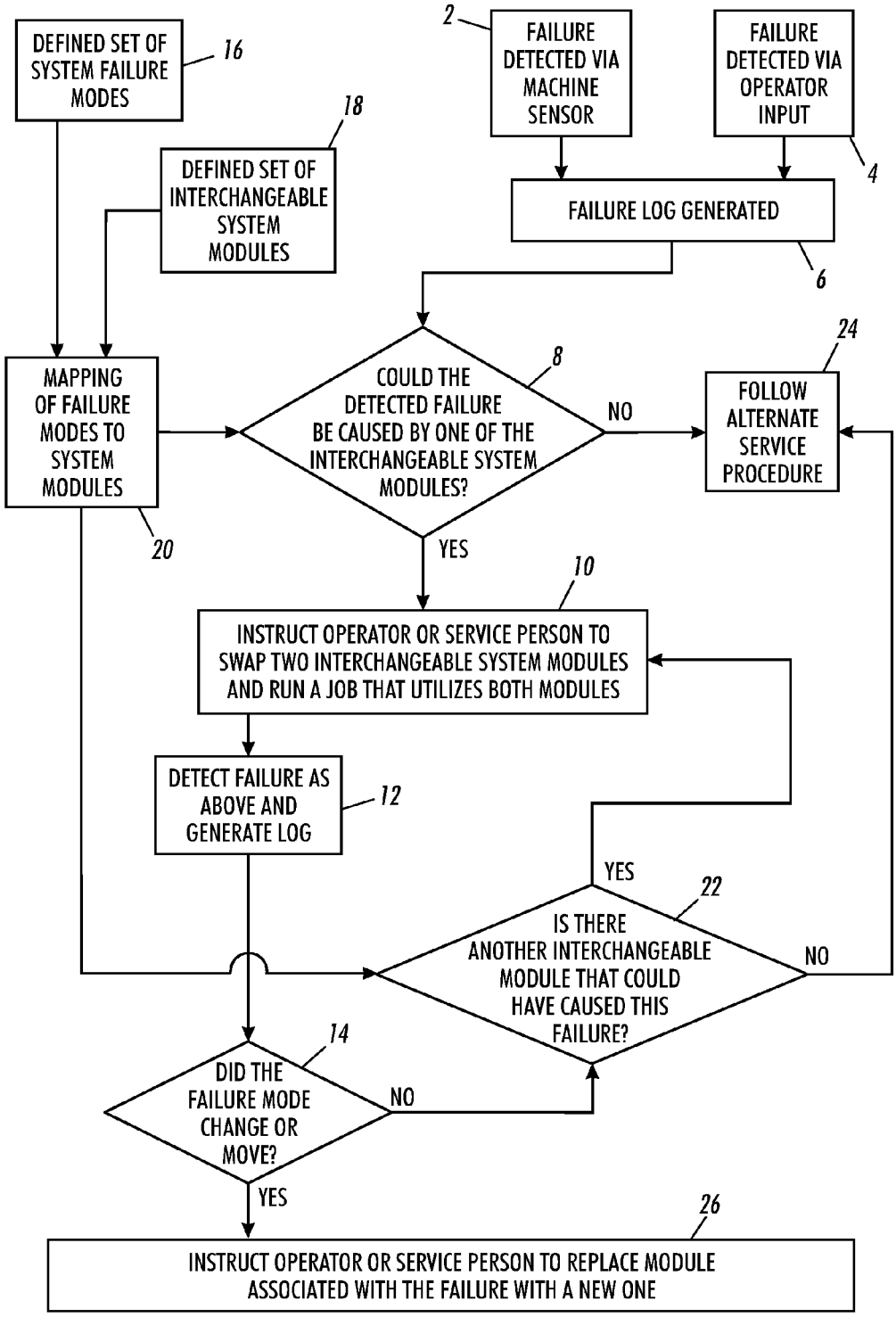
FIG. 1 is a flow chart illustrating a method for diagnosing faults associated with a modular printing system according to one exemplary embodiment.

As briefly stated in the Background section, this disclosure relates to methods and systems for diagnosing modular printing systems. For purposes of this disclosure, modular printing systems include a plurality of integrated printing system devices which include modular parts/components which are interchangeable. For example, according to one exemplary embodiment, the printing system includes two identical IMEs, two identical sheet feeder devices, and two identical sheet stacker devices, where these devices are integrated with a controller and the necessary media sheet handling to provide a complete printing system. Substantively, the methods disclosed provide a means for determining a fault has occurred within the printing system and generating instructions to swap two interchangeable modules to diagnose which module includes the failed component. This diagnostic method and system is particularly useful when the observed failure has more than one potential root cause and the multiple root causes reside in more than one replaceable module or element. The proposed method enables the user or service person to swap out each suspect element in a specific priority order until the element causing the fault is identified & replaced. Since the described diagnostic method uses elements that are already part of the current printing system the method avoids the expense associated with replacing possibly failed elements with new elements. With the described approach, a new element is used only after a failed element has been positively identified.

It is to be understood, for purposes of this disclosure and the exemplary embodiments described herein, a printing system fault can be associated with, but not limited to, a failed module, a failed part, a specific metric of print quality where the printer is otherwise operating normally, etc. Generally speaking, a fault is an indication of an operational status of the printing system.

According to one exemplary aspect of the disclosed methods and systems, provided are system diagnostics to instruct an operator to swap identical parts to see if the indicated fault is cleared. For example, if a user of the printing system is experiencing gloss defects or paper jams in a multi-engine printing system, user documentation and or user interface (UI) instructions direct a user to swap appropriate subsystems, i.e. modules, such as fuser assemblies, transport assemblies and/or other relatively easy access components. After swapping the modules, the printing system executes a specific print job to determine if the anomaly and/or failure has been corrected.

If the failure has not been corrected, the user is instructed to swap a second set of modules and the printing system executes a second print job to determine if the anomaly/failure has been corrected. This process is repeated until the failed module has been identified.

After the failed module has been identified, the failed module is replaced with a new module. Notably, the previously swapped modules may or may not be installed in their original locations.

In the event the module swapping process does not determine the failed module, a more technical approach is conducted by a service technician to determine the problem associated with the fault.

Illustrated below in Table 1 is a Failure Module Identification and Swapping Map. This map is one example of a map correlating failure modes associated with a mono, i.e. black and white, image marking engine. As will be understood by those of skill in the art, other variations of this map are constructed for other devices integrated within the modular printing system. For example, sheet feeders, color marking engines, sheet output stackers, common sheet transports, etc. It is important to note that this table not only lists the modules that could be possible root causes of the identified failure, but also gives a priority order for the modules for use in the proposed diagnostic method. Also note that while the identified "modules to swap" contain elements that could be the root cause of the failure they are not the only potential root causes of a given failure. Because of this, even if only one "swappable" module is listed in this table, that does not mean that replacement of that module will correct the identified failure mode. It simply means that we can identify or rule out that particular module as the root cause of the failure without the use of "new" elements. Further corrective actions using more traditional diagnostic methods may be required if the failed element is not identified by swapping the modules listed.

TABLE 1

FAILED MODULE IDENTIFICATION & SWAP MAPPING

| MAJOR ELEMENT | FAILURE MODE | HOW DETECTED? | 1st MODULE TO SWAP | 2nd MODULE TO SWAP | 3rd MODULE TO SWAP |
|---|---|---|---|---|---|
| Mono Marking Engines | Mono Page Gloss defect | Customer Input Image Sensor | Mono engine Fuser Modules | N/A | N/A |
| | Mono Page Image Streak | Customer Input Image Sensor | Mono engine Photoreceptor/ Cleaner/Charge Modules | Mono engine Transfer Assembly | Mono engine Imager Modules |
| | Mono Page Damage (dog-eared sheet, etc) | Customer Input | Mono engine exit gate module | N/A | N/A |
| | Mono Page Image Density Defect | Customer Input Image Sensor | Mono engine Photoreceptor/ Cleaner/Charge Modules | Mono engine Developer Modules | Mono engine Transfer Assembly |
| | Mono Page Image to Paper Registration | Customer Input Image Sensor | Mono engine media registration module | N/A | N/A |

The exemplary diagnostic methods and systems described herein may provide a user of a modular print system with cost savings associated with a smaller inventory of replacement modules.

With reference to FIG. 1, illustrated is a flow chart representing an exemplary method of diagnosing faults associated with a modular printing system according to this disclosure. As previously described, for purposes of this disclosure, a modular printing system includes any and all printing systems which include two or more interchangeable modules. For example, the printing system may include two IMEs, two fuser devices, two sheet feeder devices devices and/or two finishing devices. Moreover, each of the device pairs include one or more modules which are interchangeable. For example, but not limited to, substantially identical IMEs may include interchangeable photoreceptor modules, cleaner modules, charge modules, fuser modules and/or media registration modules, etc. Substantially equivalent sheet feeder modules may include interchangeable feed head assemblies, sensors, or transport assemblies, and finisher modules may include interchangeable stapling devices, punching devices, or nip roller modules.

With continuing reference to FIG. 1, initially the method for diagnosing the modular printing system detects a fault/failure associated with the printing system via a machine sensor 2 and/or an operator input 4 after examination of a printed output. Examples of faults include, but are not limited to, page gloss defects, page streaking/banding, page damage, page image density defects, page registration errors, etc.

Next, the process generates a log 6 to record faults associated with the printing system for further processing.

Next, the process determines 8 if the detected failure could be caused by one of the interchangeable/replaceable printing system modules by comparing the detected failure with a mapping of the failure modes 20 which is based on a defined set of system failure modes 16 and a defined set of interchangeable/replaceable system modules 18. For example, a mapping arrangement as illustrated in Table 1.

If the detected failure cannot be caused by one of the interchangeable/replaceable system modules, the process follows an alternate service procedure 24 outside the scope of the process of FIG. 1. In other words, the printing system is required to be serviced by a technician and/or possibly an alternative diagnostic process is executed to determine which component(s) are responsible for the failure.

If the detected failure can be caused by one of the interchangeable/replaceable system modules, the process proceeds to instruct 10 an operator and/or service person to swap two interchangeable/replaceable system modules according to the Failed Module Swap Map.

Next, the process detects 12 any failures of the printing system and generates a log.

Next, the process determines 14 if the failure mode changed, moved or was corrected by swapping the system modules in block 10.

If the failure was not cleared, the process proceeds to determine 22 if there is another interchangeable/replaceable module that could cause this failure. If there is another interchangeable replaceable module, the process proceeds to step 10 to instruct the operator or service person to swap the modules and the process proceeds to block 12 and 14 as previously explained.

If there is not another interchangeable/replaceable module that could have caused the failure, the process proceeds to block 24, which follows the alternative service procedure as previously explained.

If, at block 14, the process determines the failure mode was cleared and/or the failure mode moved with one of the two interchangeable/replaceable modules, the process instructs 26 an operator and/or service person to replace the module associated with the failure with a new module.

Figure 2:
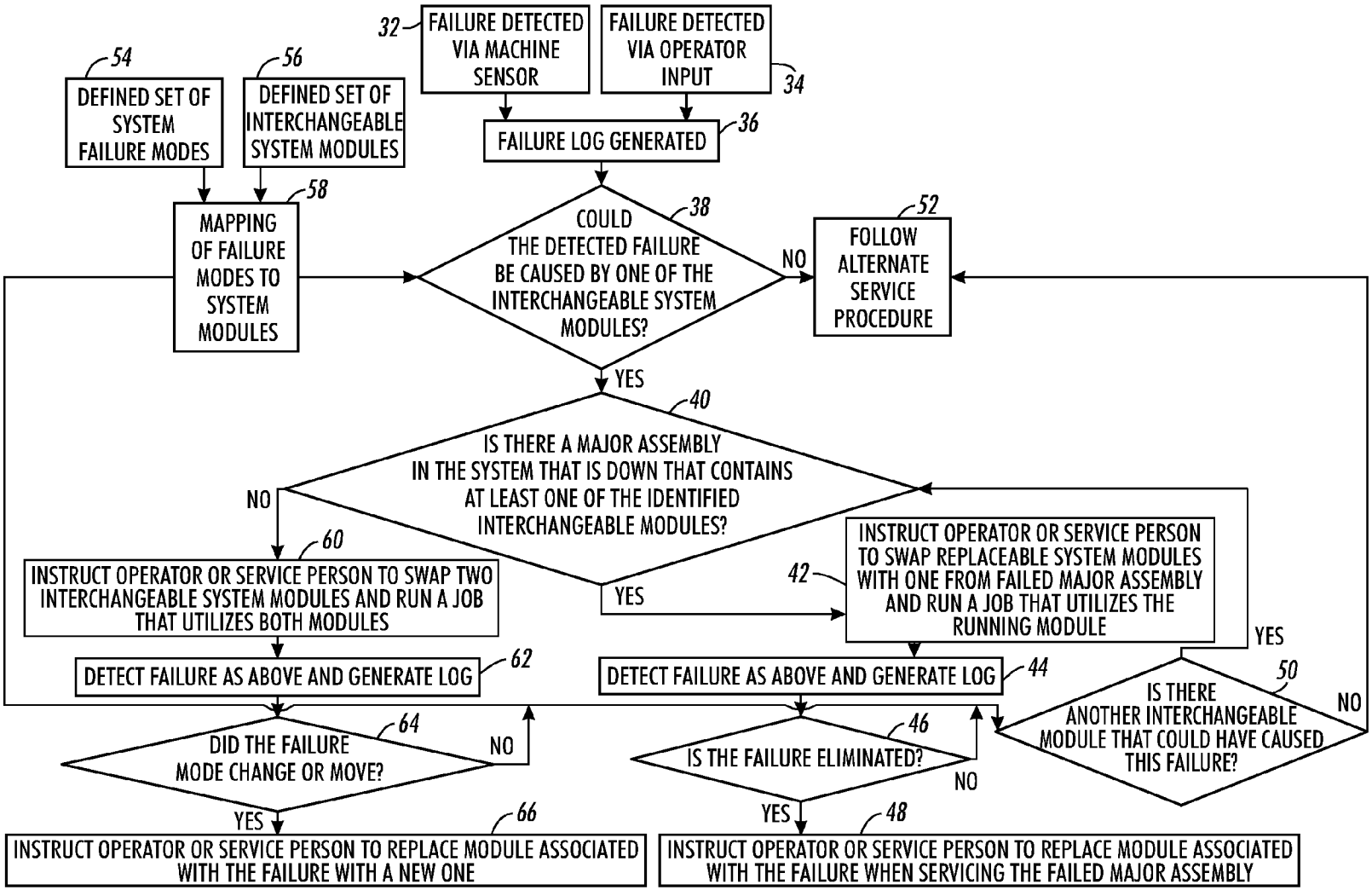
FIG. 2 is a flow chart illustrating a method for diagnosing faults associated with a modular printing system including two or more failed components according to an exemplary embodiment.

With reference to FIG. 2, illustrated is an exemplary method of diagnosing and servicing a failed module according to this disclosure.

Substantively, this method includes processes to detect a printing system failure as previously described with reference to FIG. 1, and instruct an operator/service person to preferably replace any interchangeable failed module with a normally operating interchangeable module from a device which is down for reasons unrelated to the failure. Otherwise, the method swaps modules as was described with reference to FIG. 1

With continuing reference to FIG. 2, initially the method for diagnosing the modular printing system detects a fault/failure associated with the printing system via a machine sensor 32 and/or an operator input 34 after examination of a printed output. Examples of faults include, but are not limited to, page gloss defects, page streaking/banding, page damage, page image density defects, page registration errors, etc.

Next, the process generates a log 36 to record faults associated with the printing system for further processing.

Next, the process determines 38 if the detected failure could be caused by one of the interchangeable/replaceable printing system modules by comparing the detected failure with a mapping of the failure modes 58 which is based on a defined set of system failure modes 54 and a defined set of interchangeable/replaceable system modules 56. For example, a mapping arrangement as illustrated in Table 1.

If the detected failure cannot be caused by one of the interchangeable/replaceable system modules, the process follows an alternate services procedure 24 outside the scope of the process of FIG. 1. In other words, the printing system is required to be serviced by a technician and/or possibly an alternative diagnostic process is executed to determine which component(s) are responsible for the failure.

If the detected failure can be caused by one of the interchangeable/replaceable system modules, the process proceeds to block 40 where it is determined if there is a major assembly/device that is down for other reasons and the downed major assembly includes at least one of the identified interchangeable/replaceable modules. For example, an offline IME waiting service on a module and/or component unrelated to the fault determined in block 32 and/or 34.

If block 40 determines there is a major assembly device that is down that includes an interchangeable/replaceable module, the process proceeds to block 42 to instruct an operator/service person to swap interchangeable/replaceable system modules between the failed major assembly and the device associated with the potentially failed module determined in block 58. Next, block 42 proceeds to run a print job that utilizes the module not associated with the failed major assembly.

Next, the process proceeds to block 44 where failures are detected and a log is generated.

Next, the process proceeds to block 46 to determine if the failure is eliminated. If the failure is not eliminated, the process proceeds to block 50 to determine if there is another interchangeable module that could have caused the failure detected in block 32 and/or 34.

If the determination in block 50 is negative, then the process proceeds to block 52 to follow an alternate service procedure as previously described with reference to FIG. 1.

If the determination in block 50 is affirmative, the process proceeds to block 40 and determines if there is a major assembly in the system that is down that includes at least one of the identified interchangeable modules, as previously described.

If during the execution of block 46, the process determines the failure is eliminated, the process proceeds to block 48 to instruct an operator/service person to replace the module associated with the failure when servicing the failed major assembly.

In the event process block 40 determines there is no major assembly in the system that is down which includes at least one of the identified interchangeable modules, the process proceeds to block 60 to instruct an operator/service person to swap two interchangeable system modules and run a print job that utilizes both modules.

Next, the process proceeds to block 62 to detect any failures and generate a log, as in block 36.

Next, based on the log, the process proceeds to block 64 to determine if the failure cleared and/or if the failure followed one of the respective swapped modules.

If the failure did not clear and did not follow a respective swapped module, the process proceeds to block 50 to determine if another interchangeable module could have caused this failure. From this point, the process continues as previously described with reference to block 50 and either attempts to identify the failed module by swapping another pair of interchangeable modules or, in the event no further interchangeable modules are identified, the process proceeds to block 52 to follow an alternative service procedure.

In the event the process determines at block 64, the failure followed a respective swapped module, the process proceeds to block 66 to instruct an operator/service person to replace the module associated with the failure.

Figure 3:
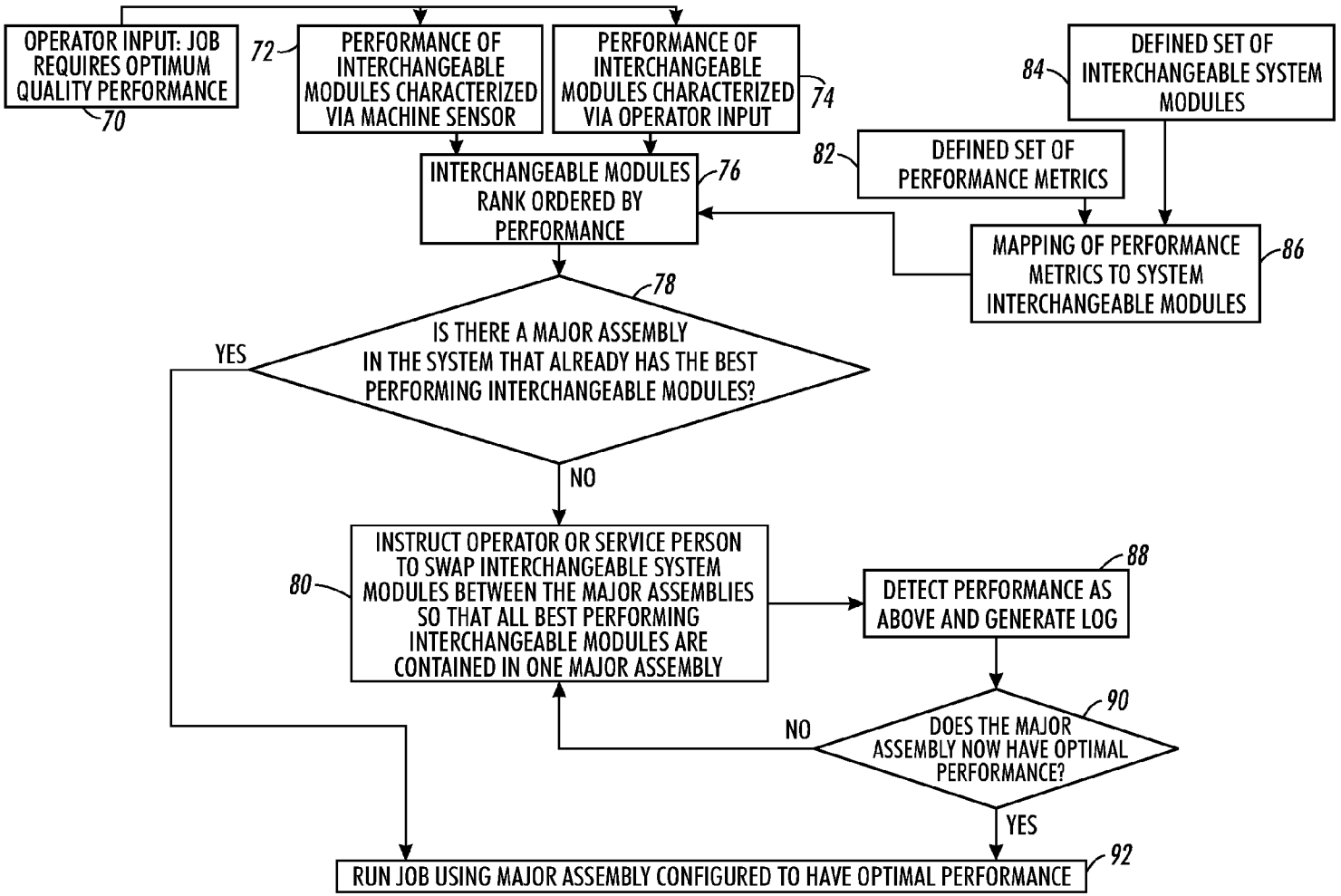
FIG. 3 is a flow chart illustrating a method for diagnosing one or more quality metrics and implementing a quality optimization configuration associated with a modular printing system according to an exemplary embodiment.

With reference to FIG. 3, illustrated is a flow chart representing an exemplary method for diagnosing one or more quality metrics and implementing a quality optimization configuration associated with a modular printing system. This method, and the processes executed in accordance with this method, provides a means for the printing system to execute a print job which requires the best performing interchangeable modules to produce an optimal output. Some examples of quality metrics include gloss level, image density, image uniformity, media surface damage, or image streaks.

Table 2 below illustrates a mapping of interchangeable modules to swap between substantially equivalent mono marking engines to achieve optimal performance on one mono marking engine.

TABLE 2

| MAJOR ELEMENT | PERFORMANCE METRIC | HOW DETECTED? | MODULE TO SWAP |
|---|---|---|---|
| Mono Marking Engines | Gloss level - page average | Customer Input Image Sensor | Mono engine Fuser Modules |
| | Image Density - solid area patch | Customer Input Image Sensor | Mono engine Photoreceptor Modules |
| | Image Uniformity - halftone patch | Customer Input Image Sensor | Mono engine Photoreceptor Modules |

Similar mapping, as illustrated in Table 2, is generated for other devices/major assemblies which include interchangeable modules, i.e. feeders, color engines, output stackers, common transports, fusers, etc.

In operation, the optimization method illustrated in FIG. 3 operates as follows.

Initially, at block 70 an operator input is received to indicate one or more print jobs require optimum performance by the printing system. The operator input can be provided by an input to a user interface operatively connected to the printing system or any other means suitable to provide communications with printing system.

Next, the process proceeds to block 72 and/or block 74, where at block 72 performance of the interchangeable modules associated with the printing system is characterized via one or more machine sensors and/or at block 74 performance of the interchangeable modules is characterized via one or more operator inputs. Machine sensors associated with the printing system can include, but are not limited to, linear array sensors and density meters. In addition, the machine sensors can be located external to the printing system where an operator characterizes the performance of the printing systems one or more interchangeable modules off-line, or the operator uses visual inspection to identify the defect. The user can then enter the characterization data via a user interface or other data port associated with the printing system.

After obtaining characterization data at block 72 and/or block 74, the process proceeds to block 76 where all similar interchangeable modules are ranked in order of performance. For example, the fuser module associated with a first marking engine produces a superior gloss level as compared to a second marking engine integrated in the printing system. Other similar type modules can include, but are not limited to, photoreceptor modules. This ranking of replaceable modules is based on a map generated at block 86 which maps the performance metrics to the printing system interchangeable modules. This mapping includes a defined set of performance metrics 82 with a defined set of interchangeable modules 84.

Next, the process proceeds to block 78 to determine if there is a major assembly/device in the system which includes the best performing interchangeable modules. If there is, the process proceeds to block 92 and runs prints jobs with the existing module configuration to achieve optimal performance.

If there is not a major assembly/device in the system which includes the best performing modules, the process proceeds to block 80 and generates instructions for an operator and/or service person to swap interchangeable modules between the major assemblies/devices to configure at least one major assembly with the best performing interchangeable modules.

Next, the process proceeds to block 88 to determine the performance of the interchangeable modules as was done in block 72 and/or block 74, and a log is generated.

Next, the process proceeds to block 90 and determines if at least one major assembly/device has optimal performance. If a major assembly is configured at optimal performance, the process proceeds to block 92 and runs the print job with the one or more major assemblies running at optimal performance.

If, at block 90, the process determines at least one major assembly is not configured to have optimal performance, the process proceeds to block 80 and, again, generates instructions to swap the relevant interchangeable modules between the major assemblies to configure at least one major assembly to perform optimally. The process then proceeds to block 88, as before, and repeats the execution of blocks 88 and 90, continuing to swap interchangeable modules until at least one major assembly includes interchangeable modules which provide optimal performance for a major assembly.

At this point, the process proceeds from block 90 to 92, where the one or more print jobs requiring optimal performance are run on one or more major assemblies configured to produce optimal results.

Figure 4:
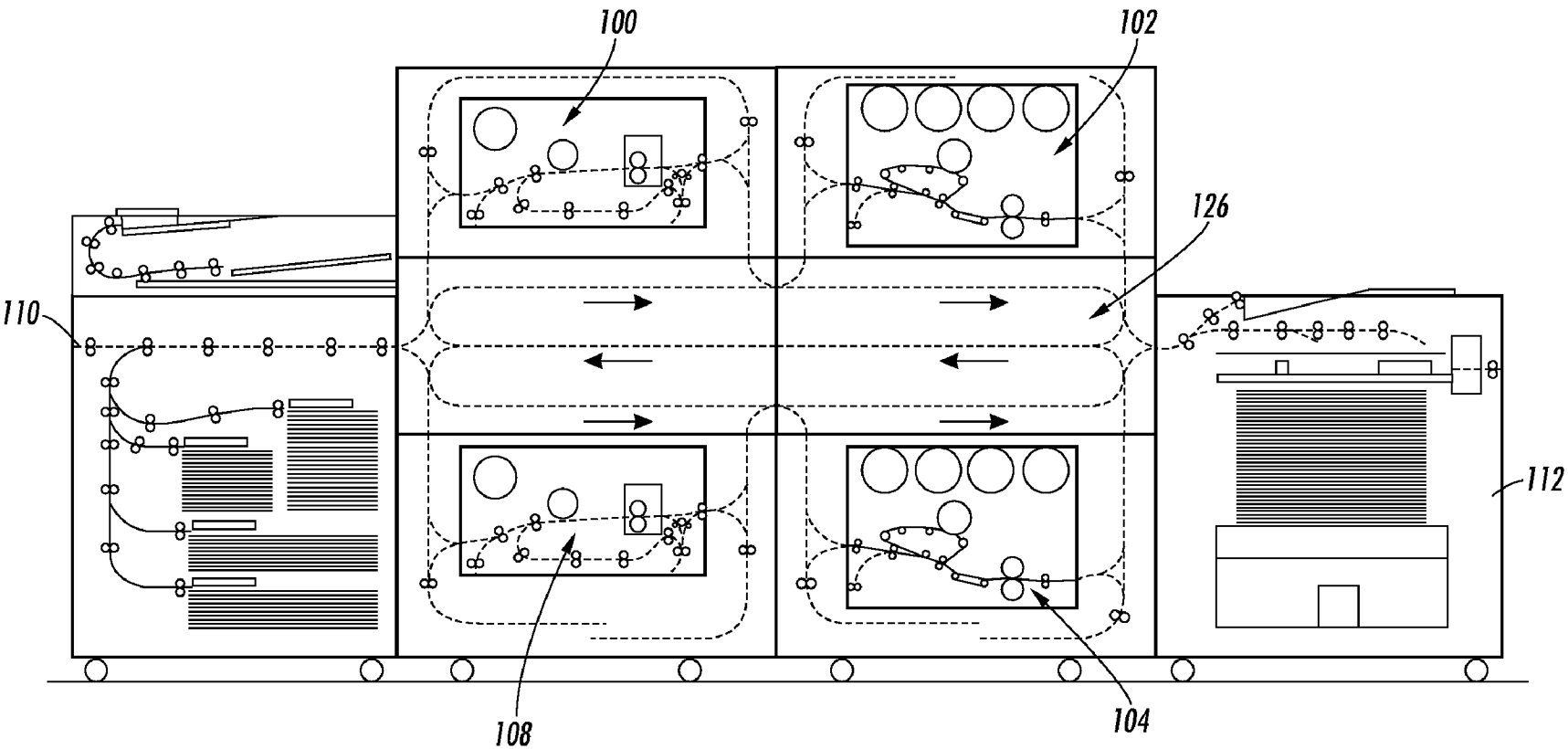
FIG. 4 schematically illustrates a modular printing system according to an exemplary embodiment of this disclosure.

With reference to FIG. 4, illustrated is an exemplary embodiment of a modular printing system according to this disclosure. The printing system includes a sheet feeder device 110, a bottom monochrome marking engine 108, a top monochrome marking engine 100, a bottom color marking engine 104, a top color marking engine 102, a media sheet transport 126 and a sheet stacker device 112.

To provide interchangeability of modules, the monochrome marking engines 108 and 100 include interchangeable modules and the color marking engines 104 and 102 include interchangeable modules.

Figure 5:
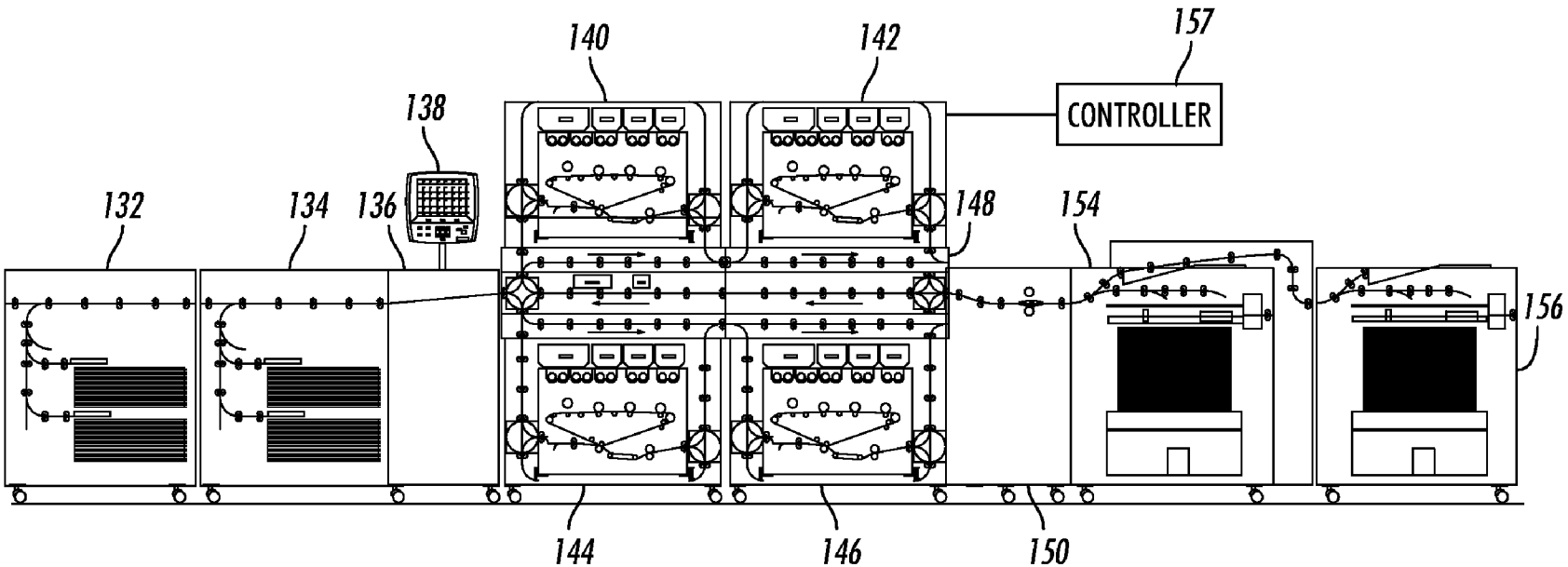
FIG. 5 schematically illustrates another exemplary embodiment of a modular printing system according to this disclosure.

With reference to FIG. 5, illustrated is another exemplary printing system according to this disclosure. The printing system includes a first sheet feeder 132, a second sheet feeder 134, a first interface device 136, a first color marking engine 144, a second color marking engine 146, a third color marking engine 140, a fourth color marking engine 142, a media transport 148, a second interface device 150, a first sheet stacker 154, a second sheet stacker 156 and a user interface 138.

To provide interchangeability of modules, the color marking engines 144, 146, 140 and 142 include interchangeable modules, the sheet feeder devices 132 and 134 include interchangeable modules, and the sheet stackers 154 and 156 include interchangeable modules. A user interface, for example a keypad and display, provide a means for an operator or service person to input data and receive instructions generated by the processes described with reference to FIG. 1-3.

A controller 157 provides a means for executing computer code to execute the processes described with reference to FIGS. 1-3. Notably, the controller can be any device capable of executing computer code, such as a server, digital front end (DFE), personal computer, etc.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A method for diagnosing a modular printing system having two or more interchangeable modules, the method comprising:

a) determining a fault associated with the printing system has occurred;

b) a controller identifying a first potentially failed module causing the fault;

c) the controller identifying a first normally operating module interchangeable with the potentially failed module;

d) the controller generating instructions to swap the first potentially failed module with the first normally operating module;

e) executing the instructions; and f) determining if the fault has been corrected subsequent to executing the instructions to swap the first potentially failed module with the first normally operating module, wherein step f) comprises:

executing a print job to determine if the fault has been corrected subsequent to executing the instructions to swap the first potentially failed module with the first normally operating module, and the controller generating instructions for a user to examine the output of the print job to determine if the fault has been corrected subsequent to executing the instructions to swap the first potentially failed module with the first normally operating module.

2. A method for diagnosing a modular printing system having two or more interchangeable modules, the method comprising:

a) determining a fault associated with the printing system has occurred;

b) a controller identifying a first potentially failed module causing the fault;

c) the controller identifying a first normally operating module interchangeable with the potentially failed module;

d) the controller generating instructions to swap the first potentially failed module with the first normally operating module;

e) executing the instructions; and f) determining if the fault has been corrected subsequent to executing the instructions to swap the first potentially failed module with the first normally operating module, wherein step f) comprises:

executing a print job to determine if the fault has been corrected subsequent to executing the instructions to swap the first potentially failed module with the first normally operating module, and monitoring the output of the print job with an image sensor to determine if the fault has been corrected subsequent to executing the instructions to swap the first potentially failed module with the first normally operating module.

3. The method according to claim 1, comprising:

g) the controller generating instructions to replace the first potentially failed module with a replacement operating module if step f) determines the fault has been corrected subsequent to executing the instruction to swap the first potentially failed module with the first normally operating module.

4. A method for diagnosing a modular printing system having two or more interchangeable modules, the method comprising:

a) determining a fault associated with the printing system has occurred;

b) a controller identifying a first potentially failed module causing the fault;

c) the controller identifying a first normally operating module interchangeable with the potentially failed module;

d) the controller generating instructions to swap the first potentially failed module with the first normally operating module;

e) executing the instructions;

f) determining if the fault has been corrected subsequent to executing the instructions to swap the first potentially failed module with the first normally operating module;

g) determining the fault has not been corrected subsequent to executing the instructions to swap the first potentially failed module with the first normally operating module;

h) the controller, identifying a second potentially failed module causing the fault;

i) the controller, identifying a second normally operating module interchangeable with the potentially failed module;

j) the controller, generating instructions to swap the second potentially failed module with the second normally operating module;

k) executing the instructions; and l) determining if the fault has been corrected subsequent to executing the instructions to swap the second potentially failed module with the second normally operating module.

5. The method according to claim 1, wherein step c) identifies a first normally operating module associated with an inoperable device associated with the modular printing system.

6. The method according to claim 1, wherein the fault associated with the printing system is associated with the printing system output quality.

7. A modular printing system controller comprising:

a controller configured to execute a method for diagnosing a modular printing system having two or more interchangeable modules, the method comprising:

a) determining a fault associated with the printing system has occurred;

b) a controller identifying a first potentially failed module causing the fault;

c) the controller identifying a first normally operating module interchangeable with the potentially failed module;

d) the controller generating instructions to swap the first potentially failed module with the first normally operating module;

e) executing the instructions; and f) determining if the fault has been corrected subsequent to executing the instructions to swap the first potentially failed module with the first normally operating module, wherein step f) comprises:

executing a print job to determine if the fault has been corrected subsequent to executing the instructions to swap the first potentially failed module with the first normally operating module, and the controller generating instructions for a user to examine the output of the print job to determine if the fault has been corrected subsequent to executing the instructions to swap the first potentially failed module with the first normally operating module.

8. A modular printing system controller comprising:

a controller configured to execute a method for diagnosing a modular printing system having two or more interchangeable modules, the method comprising:

a) determining a fault associated with the printing system has occurred;

b) a controller identifying a first potentially failed module causing the fault;

c) the controller identifying a first normally operating module interchangeable with the potentially failed module;

d) the controller generating instructions to swap the first potentially failed module with the first normally operating module;

e) executing the instructions; and f) determining if the fault has been corrected subsequent to executing the instructions to swap the first potentially failed module with the first normally operating module, wherein step f) comprises:

executing a print job to determine if the fault has been corrected subsequent to executing the instructions to swap the first potentially failed module with the first normally operating module, and monitoring the output of the print job with an image sensor to determine if the fault has been corrected subsequent to executing the instructions to swap the first potentially failed module with the first normally operating module.

9. The modular printing system controller according to claim 7, further comprising:

g) the controller generating instructions to replace the first potentially failed module with a replacement operating module if step f) determines the fault has been corrected subsequent to executing the instruction to swap the first potentially failed module with the first normally operating module.

10. A modular printing system controller comprising:

a controller configured to execute a method for diagnosing a modular printing system having two or more interchangeable modules, the method comprising:

a) determining a fault associated with the printing system has occurred;

b) a controller identifying a first potentially failed module causing the fault;

c) the controller identifying a first normally operating module interchangeable with the potentially failed module;

d) the controller generating instructions to swap the first potentially failed module with the first normally operating module;

e) executing the instructions;

f) determining if the fault has been corrected subsequent to executing the instructions to swap the first potentially failed module with the first normally operating module;

g) determining the fault has not been corrected subsequent to executing the instructions to swap the first potentially failed module with the first normally operating module;

h) the controller, identifying a second potentially failed module causing the fault;

i) the controller, identifying a second normally operating module interchangeable with the potentially failed module;

j) the controller, generating instructions to swap the second potentially failed module with the second normally operating module;

k) executing the instructions; and l) determining if the fault has been corrected subsequent to executing the instructions to swap the second potentially failed module with the second normally operating module.

11. The modular printing system controller according to claim 7, wherein step c) identifies a first normally operating module associated with an inoperable device associated with the modular printing system.

12. The modular printing system controller according to claim 7, wherein the fault associated with the printing system is associated with the printing system output quality.

13. The method according to claim 2, comprising:

g) the controller generating instructions to replace the first potentially failed module with a replacement operating module if step f) determines the fault has been corrected subsequent to executing the instruction to swap the first potentially failed module with the first normally operating module.

14. The method according to claim 2, wherein step c) identifies a first normally operating module associated with an inoperable device associated with the modular printing system.

15. The method according to claim 2, wherein the fault associated with the printing system is associated with the printing system output quality.

16. The modular printing system controller according to claim 8, further comprising:

g) the controller generating instructions to replace the first potentially failed module with a replacement operating module if step f) determines the fault has been corrected subsequent to executing the instruction to swap the first potentially failed module with the first normally operating module.

17. The modular printing system controller according to claim 8, wherein step c) identifies a first normally operating module associated with an inoperable device associated with the modular printing system.

18. The modular printing system controller according to claim 8, wherein the fault associated with the printing system is associated with the printing system output quality.

* * * * *